United States Patent [19]

Bibracher et al.

[11] Patent Number: 4,840,595

[45] Date of Patent: Jun. 20, 1989

[54] ELECTRON BEAM CATCHER FOR VELOCITY MODULATED ELECTRON TUBES

[75] Inventors: Wilhelm Bibracher, Otterloh; Josef Hauser, Bad Wiessee, both of Fed. Rep. of Germany

[73] Assignee: Siemens Aktiengesellschaft, Berlin and Munich, Fed. Rep. of Germany

[21] Appl. No.: 76,914

[22] Filed: Jul. 23, 1987

[30] Foreign Application Priority Data

Aug. 29, 1986 [DE] Fed. Rep. of Germany ..... 3629461

[51] Int. Cl.[4] ..... H01J 25/34

[52] U.S. Cl. ..... 445/28; 315/3.5; 315/5.38

[58] Field of Search ..... 445/29, 28; 315/3.5, 315/5.38

[56] References Cited

U.S. PATENT DOCUMENTS

| | | | |
|---|---|---|---|
| 3,208,126 | 9/1965 | Mims | 445/29 |
| 3,394,453 | 7/1968 | Wallace | 29/447 X |
| 3,586,100 | 6/1971 | Yasuda | 313/40 X |
| 3,612,934 | 10/1971 | Henry | 313/39 |
| 4,153,859 | 5/1979 | Gross | 315/3.5 |

FOREIGN PATENT DOCUMENTS

| | | |
|---|---|---|
| 1564629 | 5/1973 | Fed. Rep. of Germany . |
| 2449890 | 6/1976 | Fed. Rep. of Germany . |
| 2906657 | 8/1980 | Fed. Rep. of Germany . |
| 2038785 | 8/1971 | France . |
| 2219518 | 9/1974 | France . |

OTHER PUBLICATIONS

"Designing with Kennametal", A brochure by Kennametal, Inc., Latrobe, Pa., 15650; (1967), pp. 24–26.

*Primary Examiner*—Kenneth J. Ramsey

*Attorney, Agent, or Firm*—Hill, Van Santen, Steadman & Simpson

[57] ABSTRACT

An electron beam catcher for velocity modulated electron tubes which is formed as a two multi-stage collector comprising a plurality of catcher electrodes 1 and 2 surrounding the electron beam and mounted so that one follows the other in the direction of the electron beam axis and the catcher electrodes are electrically insulated from each other and are surrounded by a metallic outer envelope 3. A plurality of semicylindrical insulating parts 4 and 4' extended in the axial direction and are mounted between the catcher electrodes 1 and 2 and the outer metallic cover or vacuum envelope 3 which is heated to cause it to expand and is then shrunk onto the insulator parts 4 and 4' such that the oblong insulator parts 4 and 4' are pressed against the catcher electrodes 1 and 2 and are tightly held by the metallic outer vacuum envelope 3. The electron catcher 15 particularly useful in high powered travelling wave tubes.

5 Claims, 1 Drawing Sheet

ELECTRON BEAM CATCHER FOR VELOCITY MODULATED ELECTRON TUBES

BACKGROUND OF THE INVENTION

1. Field of the Invention

The invention relates in general to an electron beam catcher which is formed with two hollow cylindrical catcher electrodes mounted adjacent each other which are surrounded by two half cylindrical-shaped insulators and which are held by an outer conducting cylindrical sleeve.

2. Description of the Prior Art

The following patents disclose various electron beam catcher arrangements. French Pat. No. 2,219,518, French Pat. No. 2,038,785 which corresponds to U.S. Pat. No. 3,612,934, German Pat. No. 2,906,657, U.S. Pat. Nos. 3,586,100, 3,208,126, German Pat. Nos. 1,564,629 and 2,449,890.

German Pat. No. 2,449,890 discloses a multi-stage collector for velocity modulated electron tubes particularly travelling wave tubes which comprise a plurality of catcher electrodes surrounding the electron beam which are spaced from each other by insulating members or spacers which are in firm contact with the catcher electrodes and wherein the electrodes are each wrapped by a collar having a low thermal expansion as compared to the electrodes and are wrapped such that radial thermal expansion matches with the spacing members connected to the electrodes. All parts of the electron beam catcher are soldered to one another at the contacting surfaces.

German Pat. No. 1,564,629 also discloses a collector for charge carriers of electrical discharge devices which is essentially composed of carbon and is fashioned in one stage. The carbon body forming the active part of the collector is inserted into a metal envelope such that the major part of the inserted carbon body is spaced a slight distance from the metal electrode.

SUMMARY OF THE INVENTION

It is an object of the present invention to provide a multi-stage collector which provides good electrical insulation of the catcher electrode and is strong and has optimum heat dissipation of the heat caused by high electrical dissipated power and which is simple to manufacture.

It is an object of the present invention to provide an electron beam catcher for velocity modulated electron tubes which includes a plurality of cylindrical-shaped catcher electrodes through which the electron beam passes and are arranged one after the other in the direction of the electron beam and which catcher electrodes are electrically insulated from each other and are surrounded by an outer metallic envelope. The insulator parts are semicylindrical-shape and are mounted between the catcher electrodes and the outer metallic envelope and the outer metallic envelope is heated to cause it to expand after which the catcher electrodes and insulation members are inserted into the heated envelope and the heated envelope is cooled to shrink it to hold the parts firmly together and to provide superior heat removing characteristics.

The advantages obtained with the invention are that only a simple clamping technique is utilized instead of the previous involved soldering techniques for assembling the individual parts of the electron beam catcher. Thus, complicated metallization of metal/ceramic parts which must be soldered are eliminated. Also, unreliability resulting during soldering in view of the exact connections of the individual parts do not occur with the invention. As a result, of the intimate connection of the metal and the insulating parts caused by the shrinking as well as by selecting insulators having superior thermal conductivity characteristics and optimum heat removal of the stray heat occurring in the catcher electrodes is accomplished. Also, no insulation problems result due to the high electrical puncher strength between the catcher electrodes and between the catcher electrodes and the outer or vacuum envelope occur in the invention which is common in prior art electron beam catchers.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
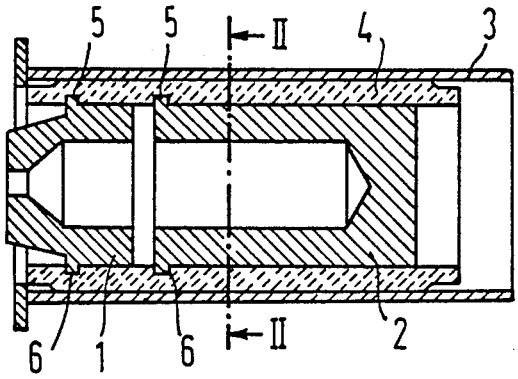
FIG. 1 is a sectional view of the electron beam catcher according to the invention.
Figure 2:
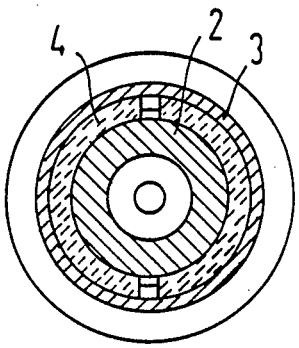
FIG. 2 is a sectional view taken on line II—II from FIG. 1.

FIGS. 1 and 2 illustrate an electron beam catcher having a two stage collector which is formed with two hollow cylindrical-shape catcher electrodes 1 and 2 which are mounted so that they are spaced from each other at a distance in the direction of the electron beam axis. The first catcher electrode 1 has an electron beam entry opening 10 through which the electron beam passes and the second catcher electrode 2 is formed as a catcher floor. So as to prevent any electrons from flowing back, the floor is formed as a tapered funnel shape as shown. A plurality of insulating members 4 extend in the axial direction around the two catcher electrodes 1 and 2 and between the catcher electrodes 1 and 2 and an outer metallic vacuum envelope 3.

In the exemplary embodiment, the oblong insulator parts 4 and 4' are formed as half cylindrical shells as illustrated in FIG. 2. It is to be realized that segments or rods, however, could also be used as the insulator parts 4 as an alternative arrangement. Other shapes of the oblong insulating parts 4 and 4' is also possible.

The oblong insulator parts 4 and 4' in the shape of two half shells are preferably composed of boron nitride, aluminum oxide, beryllium oxide or aluminum nitride. Other insulating materials having similar favorable properties, particularly a high thermal conductivity may also be utilized.

The catcher electrodes 1 and 2 and the outer or vacuum envelope 3 are preferably formed of copper. The catcher electrodes 1 and 2 and/or the outer or vacuum envelope 3 can also be made of molybdenum or similar metals or, respectively, of alloys instead of copper.

The metallic outer vacuum envelope 3 is shrunken onto the oblong insulator portions 4 and 4' after the catcher electrodes 1 and 2 have been mounted within the members 4 and 4'. By shrinking the outer envelope 3 onto the assembly, the oblong insulator half-shells 4 and 4' are firmly pressed against the catcher electrodes 1 and 2 by the metallic outer envelope 3.

Shrinking is accomplished by first placing the oblong insulator parts 4 and 4' which are half-shells in the particular example, on the spaced electrodes 1 and 2. This can be accomplished, for example, using clamps of molybdenum. The catcher electrode 1 is formed with a ring-shaped extension 5 and the catcher electrode 2 is formed with a ring-shaped extension 5 and these mate with internal grooves 6 and 6' which are formed in both of the half-shells 4 and 4' so as to accurately position the electrodes 1 and 2 in the half shells 4 and 4'. It is to be realized that the electrodes 1 and 2 could also be held in the half-shells 4 and 4' using pins, notches, steps or similar arrangements instead of the projections of 5, 5' and the grooves 6 and 6'.

Then the catcher electrodes 1 and 2 and the oblong insulator half-shells 4 and 4' are inserted into the metallic outer vacuum envelope 3 which has previously been heated to a temperature of about 500° to 800° C., for example, as, for example by heating in a furnace with quartz lamps. The outer vacuum envelope 3 is then cooled so that it shrinks onto the insulator members 4 and 4' so that the required mechanically strong connection between the catcher electrodes 1 and 2 and the oblong insulator parts 4 and 4' and the outer vacuum envelope 3 occurs. As illustrated, the outer sleeve 3 is formed with a flange 11 on its outer portion as shown.

As is shown in FIG. 2, the half shells 4 and 4' are separated by air spaces 12 and 13.

It is seen that the invention provides a new and novel apparatus and method of forming an electron beam catcher and although it has been described with respect to preferred embodiments, it is not to be so limited as changes and modifications may be made therein which are within the full intended scope as defined by the appended claims.

We claim as our invention:

1. An electron beam catcher for velocity modulated electron tubes, particularly a multi-stage collector for traveling-wave tubes, comprising, a plurality of copper catcher electrodes which are mounted to surround the electron beam and follow one another in the direction of the axis of the electron beam, said plurality of catcher electrodes electrically insulated from each other, a copper outer envelope surrounding said plurality of catcher electrodes, a plurality of oblong insulator members (4, 4') extending in the axial direction and mounted between said plurality of catcher electrodes (1, 2) and said copper outer vacuum envelope (3) and said oblong insulator members are formed as half shells; and said copper outer vacuum envelope (3) shrunk onto said plurality of oblong insulator members (4, 4') such that said plurality of oblong insulator members (4, 4') are pressed between said plurality of catcher electrodes (1, 2) and said copper outer vacuum envelope (3).

2. An electron beam catcher according to claim 1, characterized in that said plurality of oblong insulator members (4, 4') formed of boron nitride, aluminum oxide, beryllum oxide or aluminum nitride.

3. An electron beam catcher for velocity modulated electron tubes, particularly a multi-stage collector for traveling-wave tubes, comprising, a plurality of catcher electrodes which are mounted to surround the electron beam and follow one another in the direction of the axis of the electron beam, said plurality of catcher electrodes electrically insulated from each other, a metallic outer envelope surrounding said plurality of catcher electrodes, a plurality of oblong insulator members (4, 4') extending in the axial direction and mounted between said plurality of catcher electrodes (1, 2) and said metallic outer vacuum envelope (3); and said metallic outer vacuum envelope (3) shrunk onto said plurality of oblong insulator members (4, 4') such that said plurality of oblong insulator members (4, 4') are pressed between said plurality of catcher electrodes (1, 2) and said metallic outer vacuum envelope (3), characterized in that said plurality of oblong insulator members (4, 4') are formed as half-shells, segments or rods; and in that each of said plurality of catcher electrodes (1, 2) are formed with at least one projection (5, 5') and each of said plurality of oblong insulator members (4, 4') are formed with matching grooves (6, 6').

4. An electron beam catcher for velocity modulated electron tubes, particularly a multi-stage collector for traveling-wave tubes, comprising, a plurality of catcher electrodes which are mounted to surround the electron beam and follow one another in the direction of the axis of the electron bean, said plurality of catcher electrodes electrically insulated from each other, a metallic copper outer envelope surrounding said plurality of catcher electrodes, a plurality of oblong insulator members (4, 4') extending in the axial direction and mounted between said plurality of catcher electrodes (1, 2) and said metallic outer vacuum envelope (3); and said metallic outer vacuum envelope (3) shrunk onto said plurality of oblong insulator members (4, 4') such that said plurality of oblong insulator members (4, 4') are pressed between said plurality of catcher electrodes (1, 2) and said metallic outer vacuum envelope (3) characterized in that each of said plurality of catcher electrodes (1, 2) are formed with at least one projection (5, 5') and each of said plurality of oblong insulator members (4, 4') are formed with matching grooves (6, 6').

5. A method for the manufacture of an electron beam catcher for a velocity modulated electron tube comprising the steps of, placing a plurality of oblong insulator members (4, 4') which have the shape of half shells around a plurality of copper catcher electrodes (1, 2) which are spaced from each oother, heating a copper outer vacuum envelope, inserting said plurality of catcher electrodes (1, 2) and said plurality of oblong insulator members (4, 4') into said heated copper outer vacuum envelope (3) which is at a temperature of about 700° C. to 800° C.; and shrink by cooling said outer vacuum envelope (3) onto said plurality of insulator members (4, 4').

* * * * *